US005873178A

United States Patent [19]

Johnson

[11] Patent Number: 5,873,178

[45] Date of Patent: Feb. 23, 1999

[54] PORTABLE HAND DRYER

[76] Inventor: Jimmy L. Johnson, 114 Stuart Rd., Cleveland, Tenn. 37312

[21] Appl. No.: 912,074

[22] Filed: Aug. 15, 1997

[51] Int. Cl.[6] ..... F26B 19/00

[52] U.S. Cl. ..... 34/20; 34/91; 392/380

[58] Field of Search ..... 34/90, 91, 96, 34/97, 98, 104, 202; 392/381, 382, 383, 380

[56] References Cited

U.S. PATENT DOCUMENTS

| | | | |
|---|---|---|---|
| D. 352,365 | 11/1994 | Hansen et al. | D28/13 |
| 3,495,342 | 2/1970 | Goldstein | 34/546 |
| 3,667,134 | 6/1972 | Rockson | 34/60 |
| 3,712,312 | 1/1973 | Sussman | 126/206 |
| 3,797,475 | 3/1974 | Hughes | 132/73.6 |
| 4,122,396 | 10/1978 | Grazier et al. | 325/492 |
| 4,159,411 | 6/1979 | Ellersick | 219/346 |
| 4,206,556 | 6/1980 | Sabo et al. | 34/90 |
| 4,757,183 | 7/1988 | Karey et al. | 219/365 |
| 4,780,595 | 10/1988 | Alban | 219/370 |
| 4,890,395 | 1/1990 | Yamac | 34/96 |
| 4,934,066 | 6/1990 | Rose | 34/9 |
| 5,025,130 | 6/1991 | Slone | 219/203 |
| 5,103,577 | 4/1992 | Michaels et al. | 34/91 |
| 5,168,641 | 12/1992 | Smal | 34/97 |
| 5,285,050 | 2/1994 | Blackburn | 219/268 |
| 5,351,417 | 10/1994 | Rubin | 34/90 |
| 5,394,620 | 3/1995 | Chimera | 34/97 |
| 5,438,763 | 8/1995 | Yang | 34/90 |

*Primary Examiner*—Henry A. Bennett
*Assistant Examiner*—Pamela A. Wilson
*Attorney, Agent, or Firm*—Pitts & Brittian, P.C.

[57] ABSTRACT

A portable hand dryer (10) for drying wetness from an individual's hands as well as from the instruments or objects being held in their hands. The portable hand dryer (10) includes a casing (12) having an upper housing (16) defining a through opening (18) and a lower housing (20) defining having an interior cavity (24), an air current generator (14) disposed within the through opening (18) of the upper housing (16), a motor (13) received in the inner cavity (24) of the lower housing (20), and at least one control (28) to operated the hand dryer (10). In operation, manipulation of the control (28) activates the motor (13) to power the air current generator (14) to create an air current to dry object placed within the stream of that current.

20 Claims, 4 Drawing Sheets

PORTABLE HAND DRYER

This application in part discloses and claims subject matter disclosed in my earlier filed pending application, Ser. No. 08/677,479, filed on Jul. 10, 1996.

TECHNICAL FIELD

This invention relates to the field of drying appliances and, more specifically, to portable drying appliances that individuals may use to dry their hands or devices they are holding.

BACKGROUND ART

In the field of drying appliances, it is well-known that simplicity of design, ease of use, convenience and effectiveness are among the most essential elements when considering the utility of such devices. Portability is another critical element considered when the appliances are used during an operator's travels or while the operator is engaging in an activity. Such factors are equally as important to athletes, such as golfers and tennis players, as they are to lay people.

In golf, for example, players typically play under conditions in which they are prone to perspire. They can also be exposed to weather conditions, such as high humidity or rain, which cause their hands and/or equipment to become wet. Perspiration or wetness on a golfer's hands or equipment often interferes with the effectiveness of the golfer's grip on their equipment and, consequently, the quality of their play. Common remedies for these conditions include the use of a golf glove and/or a hand towel. With time and continued use, however, the golfer is left to cope with golfing with a sweat-saturated glove, a sweat-saturated hand towel or dampened equipment. The parallels to the ways in which perspiration or wetness adversely impact a tennis player's game are equally foreseeable In every day life, as well, people who carry items in their hands often find that their hands and the items that they are carrying are moistened over time due to natural perspiration, especially in warm weather conditions. Similarly, individuals using a public rest room often find themselves faced with ill-stocked or unsanitary areas to dry their hands. In each of these exemplary instances, the individuals faced with these conditions would be greatly convenienced by the availability of a personal, portable hand dryer to remedy their difficulties.

Other drying appliances are known in the art. Typical of the art are those appliances disclosed in the following U.S. Pat. Nos.:

| U.S. Pat. No. | Inventor(s) | Issue Date |
|---|---|---|
| 3,495,342 | A. Goldstein | Feb. 28, 1968 |
| 3,667,134 | T. Rockson | Jun. 06, 1972 |
| 3,712,312 | M. Sussman | Jan. 23, 1973 |
| 3,797,475 | T.B. Hughes | Mar. 19, 1974 |
| 4,159,411 | R.R. Ellersick | Jun. 26, 1979 |
| 4,206,556 | P.F. Sabo, et al. | Jun. 10, 1980 |
| 4,757,183 | H. Karey, et al. | Jul. 12, 1988 |
| 4,890,395 | Y. Yamac | Jan. 02, 1990 |
| 4,934,066 | C.F. Rose | Jun. 19, 1990 |
| 5,168,641 | H. Smal | Dec. 08, 1992 |
| 5,285,050 | W.G. Blackburn | Feb. 08, 1994 |
| 5,351,417 | R. Rubin | Oct. 04, 1994 |

Of these devices, those disclosed in the '134 patent issued to Rockson; the '475 patent to Hughes; the '312 patent issued to Sussman; the '556 patent issued to Sabo, et al.; the '183 patent to Karey, et al.; the '395 patent to Yamac; the '641 patent issued to Smal; and, the '417 patent issued to Rubin are most closely related to the present invention.

The '134 patent issued to Rockson discloses a hand dryer of specialized construction. The Rockson dryer employs sterilized air circulated in a cabinet having highly polished walls and germicidal heat lamps. The Rockson dryer is designed for continuous operation. Its specialized construction restricts its utility to hospital and related medical settings. The device is neither portable nor is it convenient to use. It requires a grounded electrical source for operation. Moreover, the specificity of its design renders it expensive and complex in construction, as well.

The '475 patent issued to Hughes discloses a portable cordless hair dryer. This device is distinguishable from the present invention in that its operation requires the creation of an exothermic reaction through the use of combustible materials such as charcoal for the production of heat. The use of such heating methods not only increases the risk of injury to the inattentive or unaware user, it also increases the likelihood of malfunction in adverse weather conditions when such heating element becomes rain soaked or moistened. The replacability of a consumed heating element for a new element increases the complexity of operation and the possibility of the malfunction of the Hughes device, as well.

The '312 patent issued to Sussman discloses a nail polishing salon which includes a lighted console; a blower behind the light bulb of the console to direct light-bulb heated air to a treatment counter; and, galleries for storage nail polishing aides. Like the device of the '134 patent, the Sussman device is of specific and limited application. It is also dependent on the presence and use of other nail polishing devices for its utility. The '312 device is also ineffectively constructed to serve as a hand dryer. It lacks convenience and portability and it relies on a solitary, grounded energy source for operability.

The '556 patent issued to Sabo, et al., discloses a nail polishing machine which is essentially identical to the Sussman device. the only distinctions are between these devices are in their configuration and the Sabo device's lack of a gallery to store nail polishing apparatus. The '556 device, otherwise, is functionally identical and subject to the same restrictions of application and use as discussed regarding the Sussman device. Consequently, the same distinctions present between the instant invention and Sussman apply equally to Sabo. The Sabo device is further distinguishable from the present invention in that it discloses and contemplates the use of only one electrical control to govern the operation of the entire device.

The '183 patent to Karey, et al., also discloses a portable hair dryer. This device is distinguishable from the present invention in that it is a non-freestanding dryer which must be stabilized by its placement in its external power source. The Karey device is also distinguishable from the present invention in that its chargeability is limited to a single type of power source and, consequently, its utility is limited to those environments in which a grounded power outlet for its power source is available. The '183 device requires that air be re-circulated for heating and it fails to provide for the removability of its power source. Karey also fails to provide for the automatic operability of the drying unit.

The '066 patent issued to Rose discloses a drying device comprising a tubular sleeve and a desiccant disposed within the tubular sleeve which engulfs and dries the grip of a wet golf club handle. In use, the desiccant is inserted into a tubular sleeve, which is configured to encase a golf club grip, and the sleeve-encased club is shaken to distribute the desiccant along the grip. A towel is then required to remove the water-laden desiccant once the sleeve is removed. The '066 device is cumbersome to use. It is ineffective in that there is no certainty of its thoroughness or uniformity in drying the grip on the golf club. Moreover, repeated use of the device likely results in granulation of the desiccant on the club grip and in the golfer's hands, all disrupting the golfer's focus on the game. The '066 device is also inefficient in the uncertainty of the time required to complete the drying process.

The '641 patent issued to Smal discloses a travel hair-drying device consisting of an internal and an external cylinder. The internal cylinder houses conventional hair dryer components and an air intake grill. The external cylinder slides over the internal cylinder and has lateral apertures which discharge air. The utility of the '641 device is restricted to hair drying. Further, it requires a grounded power source for operation.

The '417 patent issued to Rubin discloses a multi-functional hair drying device comprising a wall-mounted housing and a hand held dryer connected to the housing by an electrical cable. Like the device of the '641 patent to Smal, the utility of the '417 device is restricted to areas providing access to grounded power sources. Consequently, it lacks convenience and ease of use. The dimensions of the Rubin device also preclude its portability or use in ambient weather conditions.

The '342 patent issued to Goldstein; the '411 patent issued to Ellersick; and, the '050 patent issued to Blackburn all disclose unrelated devices. The '342 patent issued to Goldstein discloses an electromagnetic switch which controls a towel dryer and is actuated by withdrawing the towel. The '411 patent issued to Ellersick discloses an infrared radiant heating apparatus. The '050 patent issued to Blackburn discloses a battery operated cigarette lighter with a closure activated switch. None of these devices discloses a hand dryer which is portable, easy to use, is variably rechargeable and adaptable to different needs of the operator.

Therefore, it is an object of this invention to provide a means for drying moisture from a user's hands and from the instruments or devices they are holding, such as golf clubs and tennis rackets, thereby improving one's grip on the instrument or device.

It is another object of this invention to eliminate a need for supplemental drying devices, such as towels or desiccants, to be used in conjunction with the drying of one's hands and items used in one's hands.

Further, it is an object of this invention is to provide a hand dryer that is lightweight and portable so that it may be carried effortlessly, for example, on one's belt or in one's briefcase or purse.

It is another object of this invention to provide a hand dryer which is capable of being free-standing or adaptable to a fixed position.

Additionally, it is an object of this invention to provide a portable hand dryer which functions through the use of any one or more of several diverse power sources including a conventional, grounded power supply, solar power and/or rechargeable battery power packs.

It is an object of this invention to provide a portable hand dryer which has the capacity to heat the air used to dry one's hands and hand held instruments.

It is also an object of the present invention to provide a portable hand dryer having automated switching, such as a sensor, to automate the operation of the device such that the need for manipulation of the switches is obviated.

Further, it is an object of the present invention to provide a portable hand dryer which is properly sealed to preclude the entry of moisture into its electrical components and eliminate the potential for injury to the user and/or malfunction of the device.

It is another object of this invention to provide a portable hand dryer that is easy to use and is inexpensive to manufacture.

DISCLOSURE OF THE INVENTION

Other objects and advantages will be accomplished by the present invention which serves to dry moisture from an individual's hands, from the devices they are holding and from other related devices. For example, a golfer may use the portable hand dryer to dry their hands and their golf glove as well as the grip on their golf club.

The portable hand dryer includes a motor and an air current generator disposed in a casing, at least one power source to power the motor and at least one control to activate the power source. The casing includes an upper housing and a lower housing. The upper housing defines a through-opening. The air current generator is carried in the through opening of the upper housing. The lower housing defines a cavity having a distal end disposed opposite the upper housing. The lower housing is configured such that the portable hand dryer is free standing. The motor is received in the interior cavity. The power source powers the air current generator to generate the air current. The power source is variably selectable, depending upon the environment and conditions in which it is used. The at least one control regulates the operation of the portable hand dryer to facilitate the dependent or independent operation of the portable hand dryer. In operation, manipulation of the control activates the power source to power the motor. The motor powers the air current generator to generate an air current which cools and dries the moisture from an individual's hands or the objects placed within its path.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
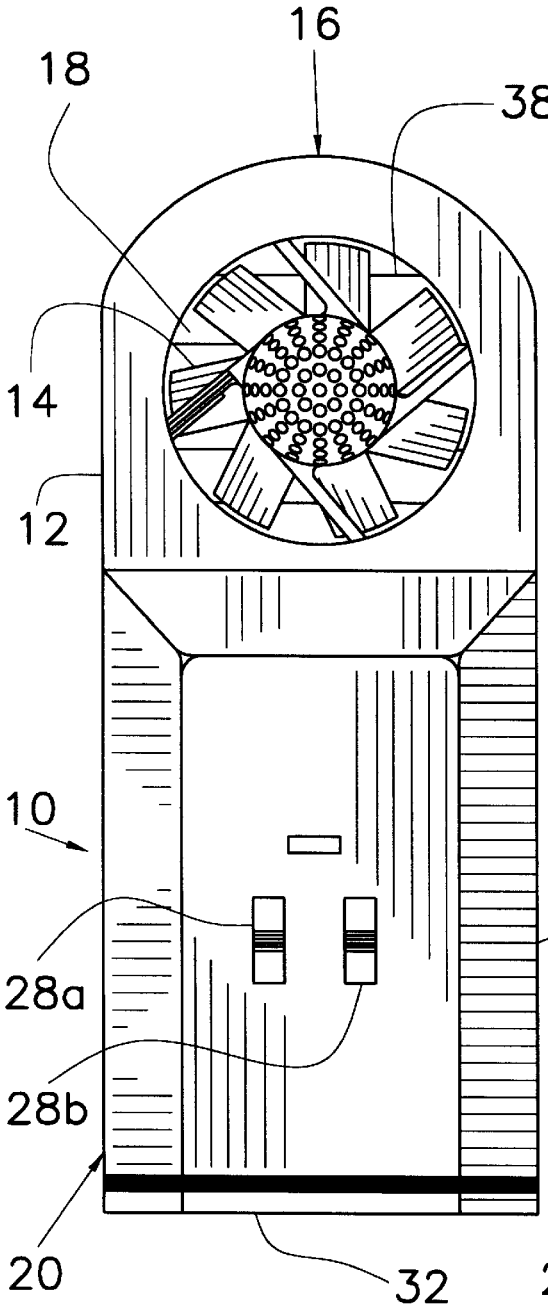
FIG. 1 is a front elevation view of the portable hand dryer constructed in accordance with several features of the present invention.

A portable hand dryer incorporating various features of the present invention is illustrated generally at 10 in the figures. The portable hand dryer 10 is designed to dry moisture from an individual's hands or the objects held in their hands. The portable hand dryer 10 of the preferred embodiment is also designed to be free standing such that an individual need not hold the dryer during use. Moreover, in the preferred embodiment, the portable hand dryer 10 is designed to be functionally automated such that an individual need not actively manipulate the controls of the dryer to operate it.

The portable hand dryer 10 includes a casing 12 and a motor 13 for operating an air current generator 14, at least one power source 36 to power the motor 13 and at least one control 28 to activate the power source 36 and operate the dryer 10. The casing 12 includes an upper housing 16 and a lower housing 20. The upper housing 16 defines a through-opening 18 and is carried by the lower housing 20. The lower housing 20 defines an interior cavity 24 having a distal end 22 disposed opposite the upper housing 16. In operation, manipulation of at least one control 28 activates at least one power source 36 to power the motor 13. The motor 13 powers the air current generator 14 to produce an air current which dries the moisture from an individual's hands or the objects placed into the resulting air stream.

Those skilled in the art will recognize that the convenience of fabricating the casing 12 of the present invention such that each of the housings 16, 20 are separate components which are removably securable to each other to further enhance the compactability and portability of the portable hand dryer 10. They will also recognize that the casing 12 is properly fabricated from any durable, moisture resistant material. As illustrated in FIGS. I and 2, however, the casing 12 of the preferred embodiment defines a unitary structure which includes the upper and lower housings 16, 20. In the preferred embodiment, the casing 12 is fabricated from a durable, light-weight plastic polymer material.

Figure 4:
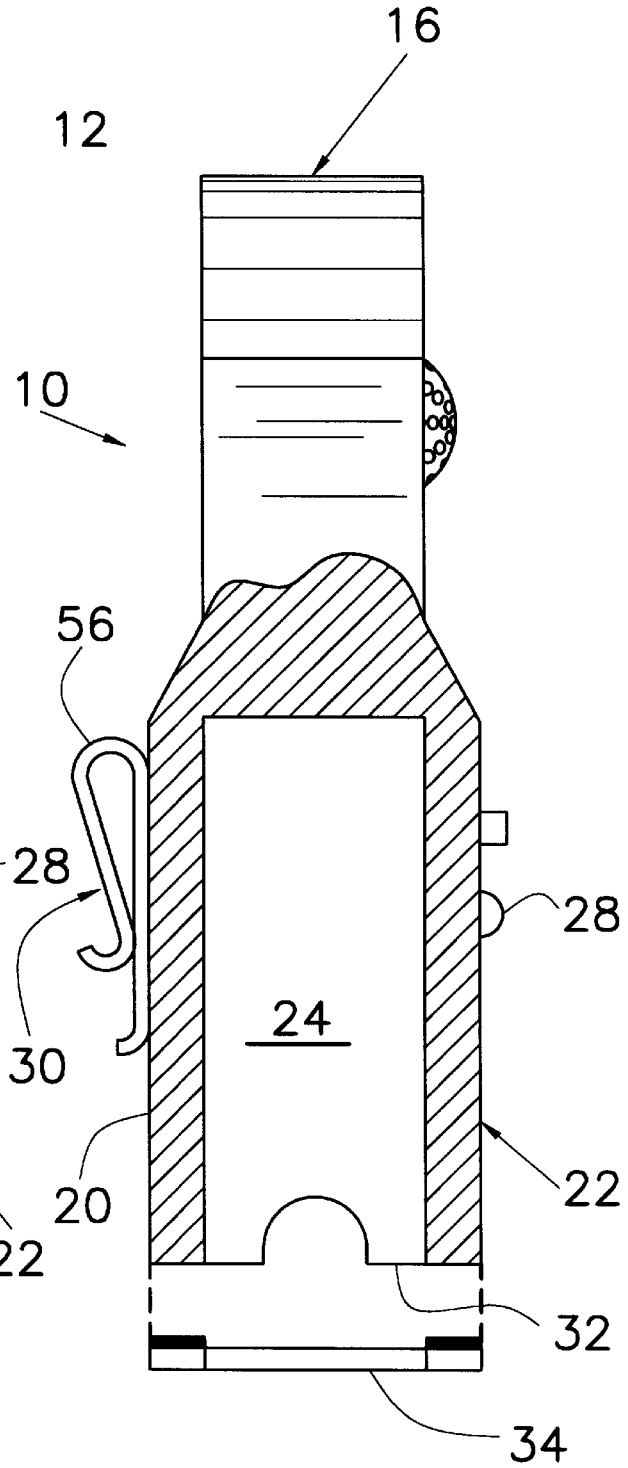
FIG. 4 illustrates a left side elevation view of the portable hand dryer of the present invention, partially in section.

The motor 13 of the portable hand dryer 10 is configured to be received in the interior cavity 24 of the lower housing 20, as illustrated in FIG. 4. In the preferred embodiment, the motor 13 is adaptable to receive power from at least one power source 36 and store that power to enable the air current generator 14 to generate an air current which dries objects placed within its field. The portable hand dryer 10 of the present invention is configured such that conventional motors are adaptable, to receive and store power and to power the air current generator 14. It is preferable, however, that the motor 13 of the portable hand dryer 10 operate with a minimum capacity of 2700 RPM. Those skilled in the art will recognize that the requisite capacity of the motor 13, along with its dimensions and its location within the casing 12 are variable according to the desired design and construction of the portable hand dryer 10.

Figure 2:
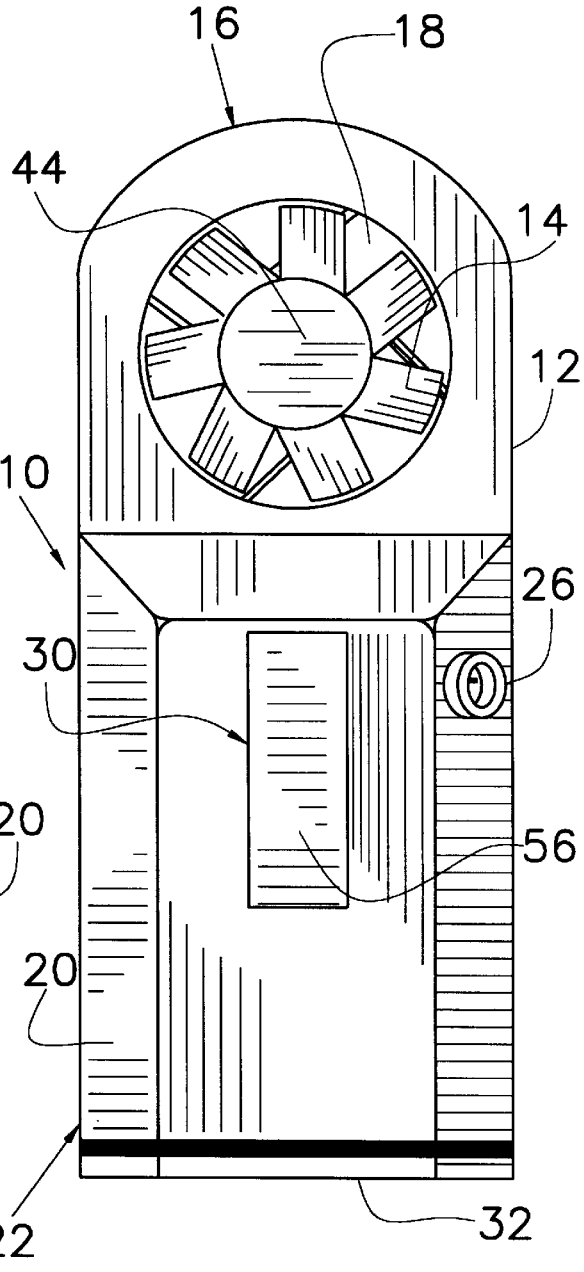
FIG. 2 is a rear elevation view of the portable hand dryer constructed in accordance with several features of the present invention.
Figure 3:
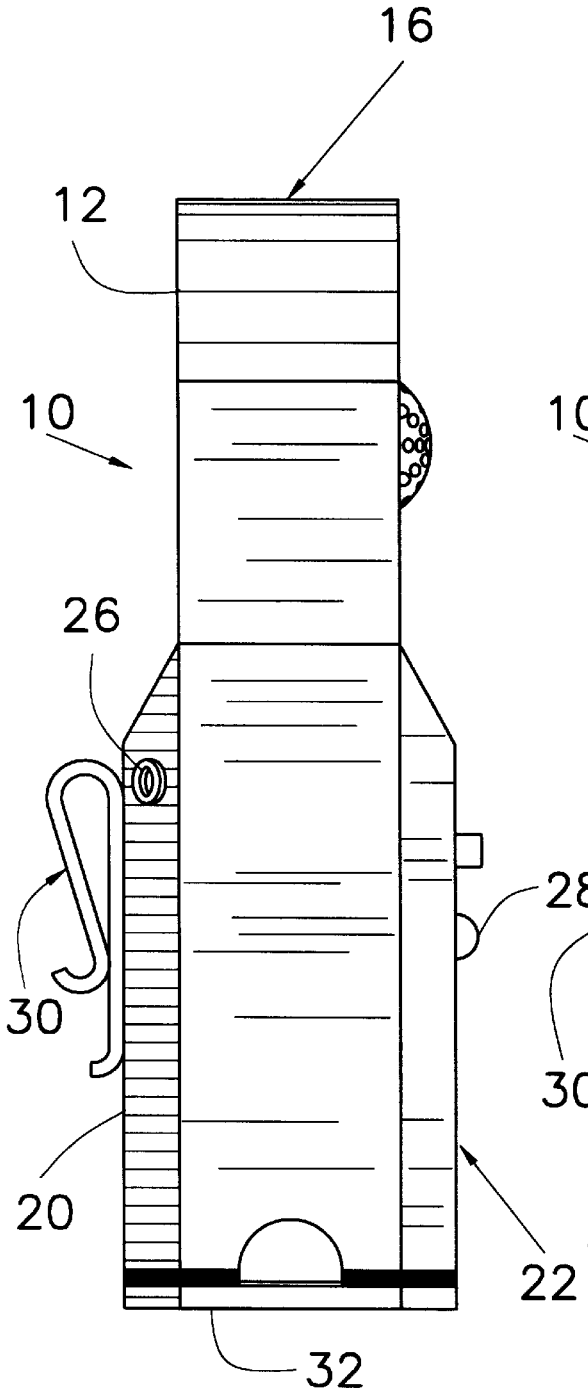
FIG. 3 illustrates a left side elevation view of the portable hand dryer of the present invention.

The air current generator 14 is configured to be received in the through opening 18 of the upper housing 16. The air current generator 14 creates an air current which alternately emanates in either direction from the through-opening 18 of the upper housing 16. In the preferred embodiment, the air current generator 14 creates an air current of a uniform direction through the through opening 18. Those skilled in the art will recognize that a number of air current generators 14 are configurable to be adapted in this environment. For example, the air current generator 14, is configurable as a straight blade fan, an oscillating fan, a vibrating fan or a fan incorporating a variable number of fan blades. As illustrated in FIGS. 1 and 2, in the preferred embodiment, the air current generator 14 includes a blade fan having 7 circularly disposed blades which rotate about a centrally disposed fan hub 44.

Figure 5:
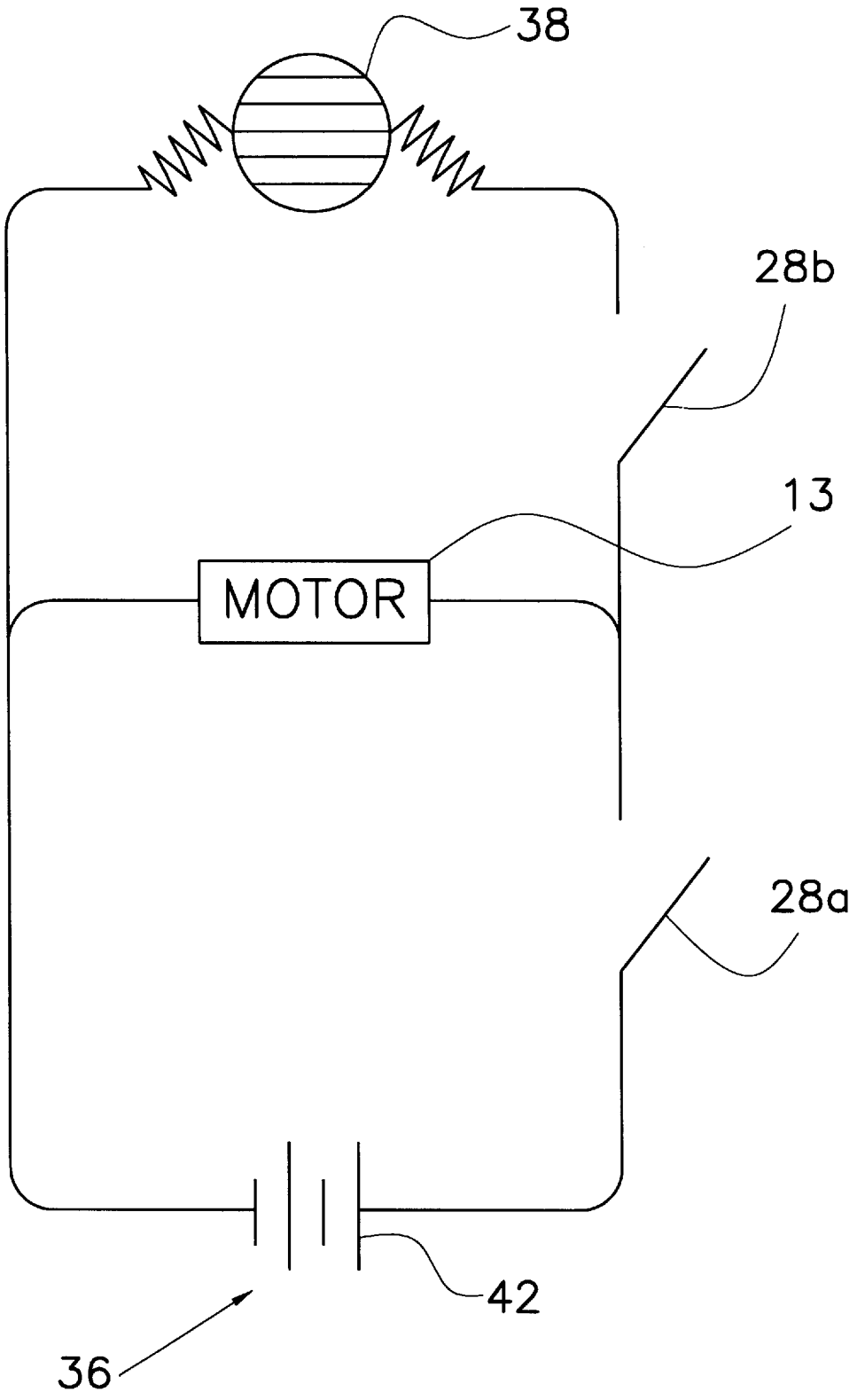
FIG. 5 is a schematic representation of an electrical circuit constructed in accordance with several features of the present invention.

The at least one power source 36 of the portable hand dryer 10 powers the air current generator 14 to generate an air current. To optimize the utility of the portable hand dryer 10, the power source 36 is variably selectable, depending upon the environment and conditions in which it is used. The portable hand dryer 10 of the preferred embodiment includes two power sources 36. The first power source 36 is a battery 42 disposed within the interior cavity 24 of the lower housing 20. FIG. 5 provides a schematic illustration of the battery 42 as one power source of the present invention. The second power source 36 includes at least one solar cell panel disposed about the casing 12 to gather and convert solar energy to power the portable hand dryer 10. Those skilled in the art will recognize that employment of two power sources 36 optimizes the utility of the portable hand dryer 10 as it is chargeable regardless of the availability of a grounded power source.

The rechargeable battery 42 of the preferred embodiment is recharged in one or more of several ways. First, the battery 42 is removable from the hand dryer 10, through its distal end 24, and is rechargeable separately from the dryer 10. Alternatively, the battery 42 is recharged by connecting it to an external power supply (not shown) through at least one electrical contact 26. The at least one electrical contact 26 is disposed on and extends through the casing 12 of the portable hand dryer 10 to communicate electrical current from the external power source to the rechargeable battery 42. Recharging the battery 42 in such a fashion is beneficial, for example, when a golfer is using a golf cart for a round of golf and the portable hand dryer 10 is recharged by connecting it to a charging cable (not shown) which extends from the dryer's contact 26 a cigarette lighter port on the golf cart. Alternatively, the dryer 10 can be recharged by connection to a grounded power source at the turn between the 9th and 10th holes while the golfer is taking a break.

Figure 6:
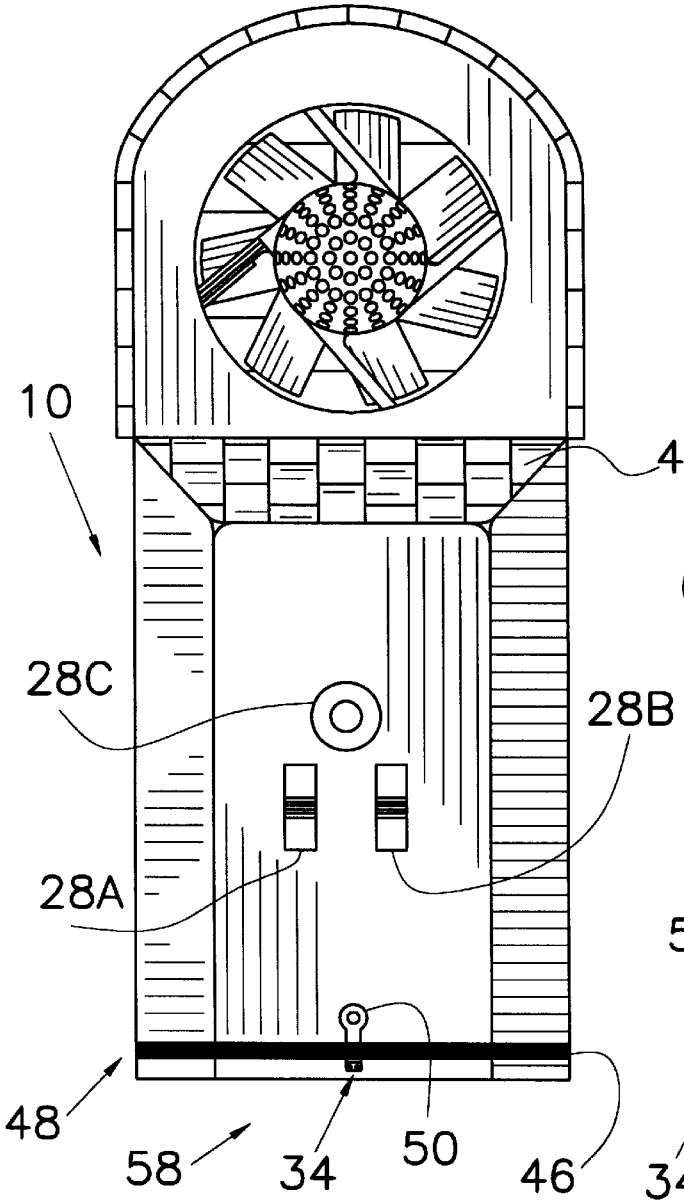
FIG. 6 is a front elevation view of the preferred embodiment of the portable hand dryer of the present invention.
Figure 7:
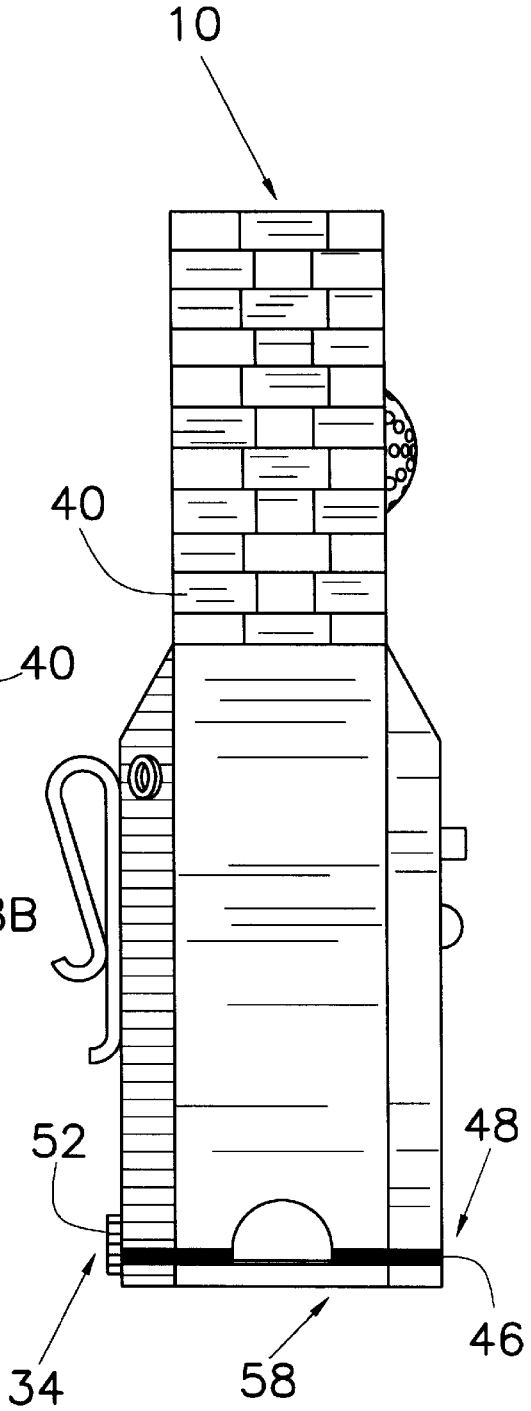
FIG. 7 illustrates a left side elevation view of the preferred embodiment of the portable hand dryer of the present invention.

In the preferred embodiment, the second power source 36 includes a plurality of solar cells 40 to power the air current generator 14 directly and recharge the battery 42, as necessary. As illustrated in FIGS. 6 and 7, the plurality of solar cells 40 are preferentially disposed about the upper housing 16 of the casing 12. Those skilled in the art will recognize that provision of the plurality of solar cells 40 on the portable hand dryer 10 augments the charging capacity of the dryer 10 as the cells 40 enables the use and recharging of the dryer 10 even when a grounded power source is unavailable simply by placing the dryer 10 in the open light.

The at least one control 28 is disposed on the casing 12 and controls the operation of the portable hand dryer 10. The at least one control 28 facilitates the dependent or independent operation of different features of the portable hand dryer 10. The integration of multiple controls 28 in the portable hand dryer 10 of the present invention further facilitates its operation. Those skilled in the art will recognize that controls 28 of diverse configurations, including switches and contact sensors, are adaptable for operation of the hand dryer 10. As illustrated in FIG. 6, in the preferred embodiment, the portable hand dryer 10 includes three controls 28A, 28B, 28C. The first control 28A is a power switch which powers the operation of the air current regulator 14. The second control 28B is a heater switch which activates a heater 38 for selectively heating the air passing through the air current generator 14 before it contacts the operator or the item held by the operator. The third control 28C is at least one sensor which cooperatively functions with one or both of the switches 28A, 28B to operate the portable hand dryer 10. In the preferred embodiment, the at least one sensor is a motion sensor 28C which is disposed on the casing 12 proximate the power switch 28A and the heater switch 28B. In this embodiment, the motion sensor 28C is integrated with the power switch 28A and the heater switch 28B such that, when either or both of the switches 28A, 28B is activated, any motion in from of the sensor 28C, such as a hand motion, activates the operation of whichever function (heat, air current or both) is desired. Use and integration of the at least one sensor 28C in the portable hand dryer 10 is particularly important where it permits free-handed operation of the dryer 10 such that an individual with wet hands can dry their hands off without having to hold or otherwise handle the dryer 10.

The heater 38 enables the operator to heat air passing through the air current generator 14 and to utilize the heated air to ventilate or dry the objects placed within the field of the air current. In the preferred embodiment, the heater 38 includes a series of thin coils or filaments which are disposed about a circumference of the through opening 18 of the casing 12 such that air is heated as it passes through the heater 38 and the through opening 18. Other air temperature regulators 38 of diverse configurations may be equally adapted for use with the portable hand dryer 10. For example, in an alternate embodiment, not shown, the heating element comprises a coil which traverse the circumference of the through opening 18. In another embodiment, also not shown, the heater 38 is disposed within the upper housing 16 of the casing 12 and radiates heat toward the fan 14 where it is used to warm the air projected into the air current.

The portable hand dryer 10 of the preferred embodiment further includes a closure 32 and a closure device 34 for releasably securing the closure to the distal end 22 of the lower housing 20 and seal the inner cavity 24 from exposure to moisture. The closure 32 also cooperates with the distal end of the casing 12 to provide a stable base 58 which enhances the stability of the free-standing portable hand dryer 10. In the preferred embodiment, the closure 32 is fabricated from the same materials that are used to fabricate the casing 12. Those skilled in the art will recognize that the closure 32 is releasably securable to the distal end 22 of the casing 12 in any of several conventional means including, for example, hook-and-loop-fasteners, nails and screws. The closure device 34 of the preferred embodiment includes a contact snap 50 and at least one hinge 52 disposed on opposed edges 54 of the distal end 22 of the casing 12. The closure 32 of the preferred embodiment further includes a gasket 46 positioned about a periphery of the closure 32 to enhance the impermeability of the closure 32 to moisture and wetness.

An attachment device 30 is also secured to the casing 12 of the portable hand dryer 10 to enable the user to carry the dryer 10 more conveniently. The attachment of the preferred embodiment is a clip 56 to facilitate the portability of the hand dryer 10 by enabling its attachment to other items such as the edge of a purse or an individual's belt. The use of other attachment devices to accomplish this objective is clearly foreseeable.

Those skilled in the art will readily recognize that a number of enhancements are adaptable to the portable had dryer 10 to render it more useful to the user. For example, in one embodiment, not shown, the casing 12 can be configured to receive a small rack-type attachment to facilitate drying items of the dimensions of a golf glove or hand towel. Braille characters are also adaptable onto the switching device 28 to render the portable hand dryer 10 useful for the visually impaired. Further, aesthetic devices, such as a cross-section of a golf ball as illustrated in FIGS. 1 and 2, or tennis ball, not shown, are attachable to the hub 44 of the air current generator 14 for simple adornment or as a marketing tool to direct the appeal of portable hand dryers 10 to target population segments and thereby enhance its sale potential.

From the foregoing description, it will be recognized by those skilled in the art that a portable hand dryer 10 offering advantages over the prior art has been provided. Specifically, the portable hand dryer 10 provides a means for drying moisture from one's hands and from hand-held instruments or other related devices. It eliminates the need for use of supplemental drying device to maintain desired dryness. The portable hand dryer 10 is also convenient to use as it is light weight and may be adapted for use with diverse power sources, including one or more of a rechargeable battery pack, a grounded power source and at least one solar cell. Further, the hand dryer 10 provides heated air to help vaporize moisture, thereby augmenting its drying capability and enhancing its utility to operator using it on a cold or damp day. The portable hand dryer 10 is also convenient to use as it is free-standing and is adaptable to be clipped on to one's belt or carrying device. It is inexpensive to manufacture. Moreover, additional features, such as braille characters disposed proximate the contacts 28, can be utilized to render the portable hand dryer 10 more useful over a broader range of the population.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A portable hand dryer comprising:

a casing having an upper housing and a lower housing, said upper housing being carried by said lower housing, said upper housing defining a through opening, said lower housing defining an interior cavity, said lower housing being configured to permit said portable hand dryer to be free-standing;

a closure positioned proximate said interior cavity of said lower housing:

a closure device for releasably securing said closure to said lower housing to close said interior cavity;

an attachment device received on said casing for enhancing portability of said hand dryer;

an air current generator for generating an air current, said air current generator being disposed within said through opening of said upper housing;

a motor for operating said air current generator, said motor being received in said interior cavity of said lower housing, said motor having capacity for receiving and storing power;

at least one power source to power said motor; and at least one control to activate operation of said hand dryer such that manipulation of said at least one control activates said at least one power source to power said motor and induce said air current generator to generate an air current which dries moisture from objects placed within said air current.

2. The portable hand dryer of claim 1 further comprising a heater for heating air in said air current generated by said air current generator.

3. The portable hand dryer of claim 2 wherein said air current generator generates an air current from said through opening of said upper housing.

4. The portable hand dryer of claim 2 wherein said air current generator generates an air current in a uniform direction from said through opening of said upper housing.

5. The portable hand dryer of claim 4 wherein said air current generator is a fan.

6. The portable hand dryer of claim 5 wherein said straight blade fan includes seven blades for circularly rotating about a centrally disposed fan hub.

7. The portable hand dryer of claim 6 wherein said portable hand dryer includes two power sources, a first power source being a rechargeable battery and a second power source being at least one solar energy cell for gathering and converting solar energy to directly power said portable hand dryer and recharge said rechargeable battery.

8. The portable hand dryer of claim 7 wherein said rechargeable battery is received in said interior cavity of said lower housing.

9. The portable hand dryer of claim 7 wherein said rechargeable battery is rechargeable by removal of said battery from said hand dryer and charging independent of said portable hand dryer.

10. The portable hand dryer of claim 7 wherein said casing further includes at least one electrical contact for enabling communication of electrical current from an external power source to said rechargeable battery, said electrical contact being disposed on said casing, said battery also being rechargeable by connection of said battery to the external power source.

11. The portable hand dryer of claim 7 wherein said second power source includes a plurality of solar energy cells, said plurality of said solar energy cells being disposed said upper housing of said casing such that absorption of solar energy is optimized.

12. The portable hand dryer of claim 2 wherein said heater is disposed about a circumference of said through opening of said upper housing proximate said air current generator.

13. The portable hand dryer of claim 1 wherein said portable hand dryer further comprises a plurality of controls to facilitate independent operation of different features of said portable hand dryer.

14. The portable hand dryer of claim 13 wherein said controls are selected from a group of controls consisting essentially of switches and sensors.

15. The portable hand dryer of claim 13 wherein said portable hand dryer includes three controls disposed on a common side of said casing, a first control for powering operation of said air current generator, said first control being an air current generator switch, a second control for activating said heater to heat air passing through said air current generator, said second control being a heater switch, and a third control having its operation integrally associated with said air current generator and said heater such that operation of each said switch is independently automated, said third control being a sensor.

16. The portable hand dryer of claim 1 wherein said closure is a hinge and a contact snap arrangement, said hinge and said snap of said hinge and contact snap arrangement being disposed on opposed sides of said lower housing proximate said interior cavity.

17. The portable hand dryer of claim 16 wherein said distal end of said lower housing further includes a seal disposed about a periphery defined by said distal end of said housing, said seal for enhancing impermeability of said closure to moisture and wetness, said seal being a gasket.

18. The portable hand dryer of claim 1 wherein said attachment device is a resilient clip.

19. A portable hand dryer comprising:

a casing having an upper housing and a lower housing, said upper housing defining a through opening, said upper housing being carried by said lower housing, said lower housing defining an interior cavity, said lower housing being configured to permit said portable hand dryer to be free-standing;

a closure having a closure device and a seal for securing said inner cavity from exposure to moisture and wetness, said closure device for releasably securing said closure to said lower housing proximate said interior cavity, said closure being configured to enable said portable hand dryer to be free standing, said closure device including a hinge and a contact snap arrangement, said hinge and said snap being disposed on opposed sides of said lower housing, proximate said interior cavity said seal being disposed about a periphery defined by said distal end of said lower housing, said seal being a gasket;

an air current generator disposed within said through opening of said upper housing for generating an air current of said through opening of said upper housing, said air current generator being a fan selected from the group of fans consisting essentially of a straight blade fan, an oscillating fan and a vibrating fan;

a heater for heating air in said air current generated by said air current generator, said heater being disposed about a circumference of said through opening of said upper housing proximate said air current generator;

a motor for operating said air current generator, said motor being received in said interior cavity of said lower housing, said motor having capacity for receiving and storing power;

two power sources to power said motor, a first power source being a rechargeable battery and a second power source being at least one solar energy cell for gathering and converting solar energy to directly power said portable hand dryer and recharge said rechargeable battery said rechargeable battery being received in said interior cavity of said lower housing, said battery being rechargeable by any combination of two recharging means in addition to said at least one solar energy cell, a first recharging means being removal of said battery from said housing and charging said battery independent of said hand dryer and a second recharging means being recharging said battery through an electrical contact which enables electrical communication from an external power source to said rechargeable battery, said at least one solar energy cell being disposed on said upper housing of said casing; and a plurality of controls to activate operation of said hand dryer, said controls being selected from the group of controls consisting essentially of sensors and switches, manipulation of at least one of said controls activating at least one of said power sources to power said motor and said air current generator to produce an air current which dries moisture from objects placed within said air current.

20. A portable hand dryer comprising:

a casing, having an upper housing and a lower housing, said upper housing defining a through opening, said upper housing being carried by said lower housing, said lower housing defining an interior cavity, said lower housing being configured to permit said portable hand dryer to be free-standing;

a closure having a closure device and a seal for securing said inner cavity from exposure to moisture and wetness, said closure device for releasably securing said closure to said lower housing proximate said interior cavity, said closure being configured to enable said portable hand dryer to be free standing, said closure device including a hinge and a contact snap arrangement, said hinge and said snap being disposed on opposed sides of said lower housing, said seal being disposed about a periphery defined by said distal end of said lower housing, said seal being a gasket;

an air current generator disposed within said through opening of said upper housing for generating an air current in a uniform direction from said through opening of said upper housing, said air current generator being a straight blade fan having seven circularly disposed blades for rotating about a centrally disposed fan hub;

a heater for heating air in said air current generated by said air current generator, said heater being disposed about a circumference of said through opening of said upper housing proximate said air current generator;

a motor for operating said air current generator, said motor being received in said interior cavity of said lower housing, said motor having capacity for receiving and storing power;

two power sources to power said motor, a first power source being a rechargeable battery and a second power source being a plurality of solar energy cells for gathering and converting solar energy to directly power said portable hand dryer and recharge said rechargeable battery, said rechargeable battery being received in said interior cavity of said lower housing, said battery being rechargeable by any combination of two recharging means in addition to said plurality solar energy cells, a first recharging means being removal of said battery from said housing and charging said battery independent of said hand dryer and a second recharging means being recharging said battery through an electrical contact which enables electrical communication from an external power source to said rechargeable battery, said plurality of solar energy cells being disposed on said upper housing of said casing; and three controls for activating operation of said hand dryer, said controls being disposed on a common side of said casing, said controls including a first control for powering operation of said air current generator, a second control for activating said heater, and a third control whose operation is integrated with that of said air current generator and said heater such that operation of each switch is automated, said third control being a sensor, manipulation of at least one of said controls activating at least one of said power sources to power said motor and said air current generator to produce an air current which dries moisture from objects placed within said air current.

* * * * *